United States Patent [19]

Blanke, Jr.

[11] Patent Number: 4,874,094

[45] Date of Patent: Oct. 17, 1989

[54] CUSHIONED BAG

[76] Inventor: Richard H. Blanke, Jr., 9102 Clayton Rd., St. Louis, Mo. 63124

[21] Appl. No.: 867,889

[22] Filed: May 19, 1986

Related U.S. Application Data

[63] Continuation of Ser. No. 608,526, May 8, 1984, abandoned, which is a continuation of Ser. No. 433,636, Oct. 12, 1982, abandoned.

[51] Int. Cl.[4] ..... B65D 81/02

[52] U.S. Cl. ..... 206/522; 206/586; 206/594; 383/110; 383/120

[58] Field of Search ..... 206/522, 586, 594; 383/112, 120, 110, 109

[56] References Cited

U.S. PATENT DOCUMENTS

| | | | |
|---|---|---|---|
| 2,300,473 | 11/1942 | Winkle | 206/594 |
| 2,314,876 | 3/1943 | Greene | 383/112 |
| 2,319,966 | 5/1943 | Wood et al. | 206/594 |
| 2,744,624 | 5/1956 | Hoogstoel et al. | 206/594 |
| 3,005,567 | 10/1961 | White | 206/522 |
| 3,142,599 | 7/1964 | Chavannes | 206/522 |
| 3,259,301 | 7/1966 | Onasch | 383/112 |
| 3,581,883 | 6/1971 | Whitney | 206/594 |
| 3,587,794 | 6/1971 | Mattel | 206/522 |
| 3,812,001 | 5/1974 | Ryan | 206/594 |
| 3,889,743 | 6/1975 | Presnick | 206/522 |
| 4,093,068 | 6/1978 | Smrt | 206/522 |
| 4,314,638 | 2/1982 | Gordon et al. | 206/594 |

FOREIGN PATENT DOCUMENTS

| | | | |
|---|---|---|---|
| 71891 | 10/1959 | France | 206/522 |
| 1585083 | 12/1969 | France | 206/522 |

*Primary Examiner*—Joseph Man-Fu Moy

*Attorney, Agent, or Firm*—Cohn, Powell & Hind

[57] ABSTRACT

This cushioned bag includes a double layer of plastic with longitudinal columns formed therebetween. The columns contain cushioning material such as air. The bag has a tubular outer portion providing an outer wall and an inner portion providing an inner wall and cooperating with the outer wall to define the columns. The inner wall is connected to the outer wall intermediate to the columns. The method of manufacturing the cushioned bag comprises the steps of extruding the outer tubular member, extruding the inner tubular member having castled portions spaced from the outer member, sealing the inner member to the outer member between the castled portions, cutting the tubular members into individual bag lengths, sealing one end of the cut tubular members to provide a closed bottom portion and sealing the other end of the outer tubular member to the castled portions to provide closed upper ends of the castled portions.

3 Claims, 1 Drawing Sheet

CUSHIONED BAG

This application is a continuation of application Serial No. 608,526, filed May 8, 1984, which is a continuation of Ser. No. 433,636, filed Oct. 12, 1982, both now abandoned.

BACKGROUND OF THE INVENTION

This invention relates to a bag in general and particularly to a bag having cushion columns members and a method of manufacturing such bags. In the prior art double walled plastic bags are formed with concentric walls. Such bags are formed in tube extruders in which plastic is extruded through rings of extruder head vertically and drawn upward for cooling and folding. Such double walled bags provide additional strength over single walled bags, however, prior double walled bags do not include cushion elements. Because such bags are not cushioned they are not usable with fragile items such as perishable fruits or vegetables which generally must be stored and transported in rigid containers. Fragile and perishable items are currently packed in chipboard, corrugated and wood boxes.

SUMMARY OF THE INVENTION

This cushioned bag provides a bag with spaced cushion columns for cushioning and protecting fragile and perishable items.

The cushioned bag includes a tubular outer portion providing an outer wall and an inner portion providing an inner wall and defining a plurality of spaced cushion columns within the outer wall. In one aspect of the invention the cushioned bag includes a double layer of material having longitudinal columns formed therebetween. The columns contain cushioning material.

In another aspect of the invention the inner wall is connected to the outer portion intermediate of the spaced columns. In one aspect the inner and outer portions are formed of plastic material.

In still another aspect of the invention the cushion columns are formed longitudinally of the outer wall. In yet another aspect of the invention, the cushion columns are air filled.

In one aspect of the invention the method of manufacturing the cushioned bag includes extruding the outer tubular member with a round cross-section and extruding the inner member with an annular castellated cross-section with castled portions spaced from the outer tubular member. The inner tubular member is longitudinally sealed to the outer tubular member between the castled portions. The tubular members are cut into individual bag lengths and one end of the tubular member is sealed to provide a closed bottom portion. The other end of the outer tubular member is sealed to provide closed upper ends of the castled portions.

DESCRIPTION OF THE PREFERRED EMBODIMENT

Figure 1:
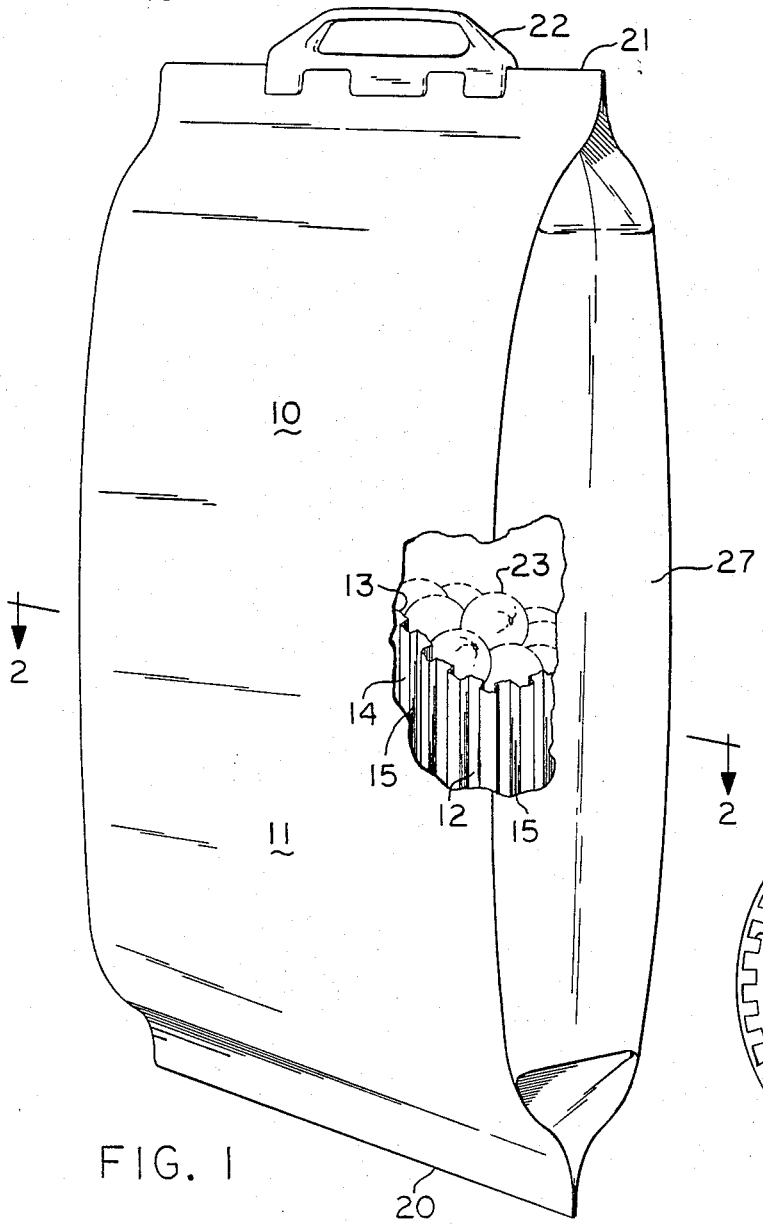
FIG. 1 shows a perspective view partially cut away of the cushioned bag.

Referring now by characters of reference to the drawings and first to FIG. 1 it will be understood that the cushioned bag indicated generally by 10 includes a tubular outer portion comprising an outer wall 11 and an inner portion providing an inner wall 12. The inner wall 12 includes castled portions 13 spaced from the outer wall 11, intermediate portions 14 which are connected to the outer wall 11 and side portions 15 which interconnect the castled and intermediate portions 13 and 14. The castled portions 13, side portions 15 and outer wall 11 define spaced columns 16 which are filled with cushioning material such as air.

The bag 10 includes a lower end 20 which is sealed shut for sealing the columns 16 and the bag bottom. At the bag top 21 the castled portions 13 and side portions 15 are sealed to the outer wall 11 for sealing the columns 16. The bag top 21 can be sealed shut as shown in FIG. 1 and a handle 33 can be attached for carrying the bag as by heat sealing or ultrasonic sealing. Bag sides 27 are formed by folding opposed longitudinal sections of the inner and outer walls 12 and 11 inwardly before sealing the bag bottom 20 and top 21. The bag 10 can hold fragile or perishable items such as the fruit or vegetables indicated by 23.

Figure 2:
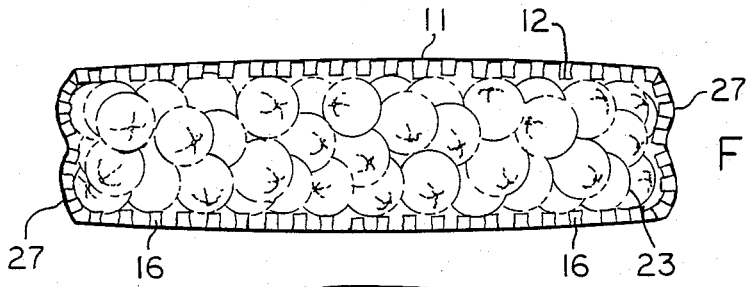
FIG. 2 is a cross-sectional view of the cushioned bag taken on line 2—2 of FIG. 1.
Figure 3:
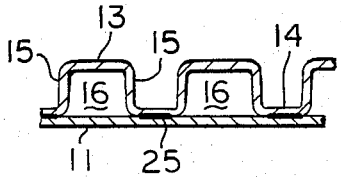
FIG. 3 is an enlarged fragmentary cross-sectional view of a wall of the bag of FIG. 1.

As is best seen in FIG. 2 the outer wall 11 and inner wall 12 provides the plurality of longitudinal columns 16 which are spaced about the interior of the bag. In FIG. 3, it can be seen that the inner portion is sealed to the outer portion between the columns 15 at the seal 25.

Figure 4:
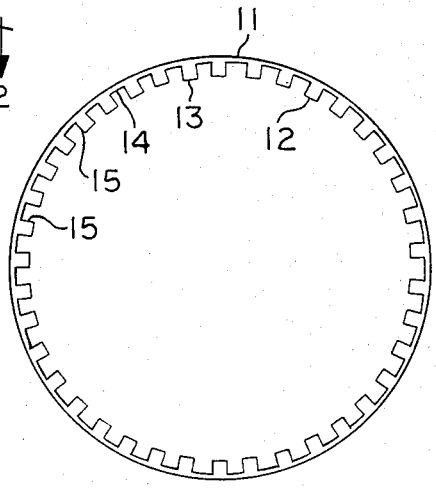
FIG. 4 is a cross-sectional view showing the inner and outer bag walls as extruded.

Referring now to FIG. 4 the manufacture of the cushioned bag will be described. The cushioned bag 10 of FIG. 1 can be manufactured by a double extrusion process where the inner wall 12 and outer wall 11 are extruded at the same time. The extrusion of double walled bags being well known in the art.

The bag walls 11 and 12 are formed of plastic material such as polyolefin polymers.

While the inner and outer walls 12 and 11 are still hot, and in the extruder, the inner wall intermediate portions 14 can be brought into contact with the outer wall 11 as by use of rollers or blowers. The inner and outer walls at this time are still in a hot plastic state and upon contact of the inner wall intermediate portion 14 to the outer wall 11 a seal will be formed therebetween. This seal is represented by the area 25 shown in FIG. 3. A continuous seal is provided between the inner wall intermediate portion 14 and the outer wall portion 11 of the tubular material. As is conventional in the art, the extruded inner and outer portions 11 and 12 are drawin upwardly from the extruder for cooling and folding.

In order to make individual bags the tubular inner and outer walls after being sealed together and folded are cut into individual bag lengths and the bag bottom 20 is sealed closed as by heating or ultrasonic sealing. This sealing also seals the bottom ends of the columns 16. The columns 16 can be filled with air or other cushioning material and the tops of the columns 16 are sealed to the outer wall 11 to seal in the cushioning material. The bag 10 is now prepared and can be filled with material such as fruit or vegetables to be packaged. Once filled the bag top 21 can be sealed ad a handle 22 added if desired.

I claim as my invention:

1. A cushioned bag comprising:

(a) an extruded plastic, continuously formed tubular outer wall, (b) an extruded plastic, continuously formed tubular inner wall coextensive with said outer wall and having a plurality of spaced, longitudinally extending channel portions and longitudinally extending intermediate portions, (c) continuous longitudinal sealing means, sealing said inner wall intermediate portions to said outer wall between the top and bottom of said bag and defining longitudinally extending columns, and (d) continuous transverse sealing means, sealing said inner wall to said outer wall and cooperating with said longitudinally sealing means to define a plurality of sealed cushion columns of air and substantially sealing top and bottom of the bag shut.

2. A cushioned bag as defined in claim 1, in which:

(e) said channel portions are substantially inwardly rectangular formed and have an interrupted length between said transverse seals.

3. A cushioned bag as defined in claim 1, in which:

(e) opposed longitudinal bag sections are inwardly folded to form cushioned bag sides, the transverse sealing means sealing said opposed longitudinal sections and said sides together.

* * * * *